US006598527B1

(12) United States Patent
Harper-Smith et al.

(10) Patent No.: US 6,598,527 B1
(45) Date of Patent: Jul. 29, 2003

(54) METHOD OF INSURING PRECISE COLOR CONSISTENCY

(75) Inventors: Jon Harper-Smith, Burwash (GB); Terry L. Amerine, Shawnee Mission, KS (US)

(73) Assignee: Sericol Limited, Broadstairs (GB)

( * ) Notice: Subject to any disclaimer, the term of this patent is extended or adjusted under 35 U.S.C. 154(b) by 446 days.

(21) Appl. No.: 09/696,671

(22) Filed: Oct. 26, 2000

(51) Int. Cl.[7] ..... B41F 1/54
(52) U.S. Cl. ..... 101/484; 101/491; 101/211
(58) Field of Search ..... 101/35, 483, 484, 101/491, 211, DIG. 29

(56) References Cited

U.S. PATENT DOCUMENTS 5,668,633 A * 9/1997 Cheetam et al. ..... 356/402
5,841,421 A * 11/1998 Cheetam et al. ..... 345/593

FOREIGN PATENT DOCUMENTS

JP 08127743 A * 5/1996 ..... C09D/7/14

* cited by examiner

*Primary Examiner*—Ren Yan
*Assistant Examiner*—Minh H Chau
(74) *Attorney, Agent, or Firm*—Nixon & Vanderhye P.C.

(57) ABSTRACT

Products are screen printed at a plurality of geographically remote printing facilities with precisely defined and formulated colored inks so that the products produced at each of the facilities are substantially indistinguishable by the naked human eye. Ink formulation cards and a sample product with the precisely defined colors printed on it, are sent to each of the printing facilities. Depending upon the particular environmental conditions in the various printing facilities the formulations for various colors may differ from location to location, in order to get uniform products. Compact discs, plastic bottles, promotional clothing, signage, and like products may all be effectively handled in this manner.

19 Claims, 5 Drawing Sheets

METHOD OF INSURING PRECISE COLOR CONSISTENCY

BACKGROUND AND SUMMARY OF THE INVENTION

There are many circumstances in which it is necessary or desirable for an organization to provide products (such as compact discs, plastic bottles, promotional clothing, signage, or the like) printed (typically screen printed) at a plurality of geographically remote locations, yet provide highly controlled consistency of the colors of the printed products. The geographically remote facilities may be independent vendors, and/or may be printing locations for a particular organization, and the facilities may be located on different continents, and/or in geographically remote places within different countries and/or within the same country.

Obtaining strict uniformity of the colors of the printed products at geographically remote locations has been a very difficult task in the past. Even if the same inks are supplied by a common vendor to each of the geographically remote locations, the colors may turn out different due to different environmental conditions at the geographically remote locations. For example, different locations may use different equipment, have different temperature and humidity conditions, and/or have differences in local practice or local additives, that result in a particular color looking different on a printed product from one location than in another even if exactly the same ink is supplied by a common vendor.

According to the present invention, the problems set forth above are greatly reduced, and in fact typically substantially eliminated, by providing a method and/or kit to geographically remote facilities that allows printing of products (which are typically objects, such as compact discs, plastic bottles, promotional clothing, or signage, and not documents), typically by screen printing, so that products produced at each of the geographically remote locations have colors that are substantially indistinguishable by the naked human eye from one location to the next. The invention is versatile and applicable to geographically remote locations within the same organization, and/or independent contractors/venders which produce the products at remote locations for a-particular organization.

According to one aspect of the present invention there is provided a method of insuring precise color consistency of substantially identical printed products printed at a plurality of different geographically remote locations having different environmental criteria, comprising: a) Specifying a plurality of precisely defined colors to be printed on the products. b) Determining a plurality of different reproducible ink formulation for each of the plurality of precisely defined colors, the plurality of formulations differing depending upon the different environmental criteria so that regardless of the environmental criteria the colors when printed will be substantially indistinguishable by the naked human eye. And c) distributing the formulations from b), and supplying ink for use in formulating inks based on the formulations, to the plurality of different geographically remote locations, so that products may be printed at each of the geographically remote locations which have colors that are substantially indistinguishable by the naked human eye from one location to the other.

The method as set forth above may further comprise d) screen printing the products at the geographically remote locations with the precisely defined colors. Also, c) may be further practiced to distribute with each formulation a sample product having the precisely defined colors printed thereon. The method may also comprise e) distributing to each of the geographically remote locations common equipment for use in at least one of verifying, formulating ink, and printing of the precisely defined colors. For example e) is further practiced by distributing a common spectrophotometer, and the method further comprises f) verifying the colors to be printed by comparing the colors on the sample to specimen colors printed at one of the geographically remote locations. While a wide variety of products may be used, the invention is particularly applicable for compact discs, and c) may be practiced by distributing sample compact discs.

In the method c) may be further practiced by distributing the formulations in the form of cards, each card having the complete formulation for each precisely defined color, including the various inks and percentages of the various inks making up each color, imaged thereon. Also, c) may be still further practiced by distributing cards having the ink formulations on one face thereof, and product-simulating indicia on another face thereof, which product-simulating indicia accurately simulates the sample product, including the precisely defined colors thereof. Also c) may be further practiced by distributing each sample product and corresponding color formulation card together in a set, releasably held together (e.g. in a carrier).

The method may also further comprise f) obtaining actual printed product samples from each of the geographically remote locations and approving the samples; and after d), e) running screen printing production runs of the printed products and distributing the printed products from the production runs.

According to another aspect of the present invention there is provided a method of insuring precise color consistency of substantially identical printed products printed at a plurality of different geographically remote locations having different environmental criteria, comprising: a) Specifying a plurality of precisely defined colors to be printed on the products. b) Determining a plurality of different reproducible ink formulation for each of the plurality of precisely defined colors, the plurality of formulations differing depending upon the different environmental criteria so that regardless of the environmental criteria the colors when printed will be substantially indistinguishable by the naked human eye. And c) distributing the formulations from b) to the plurality of different geographically remote locations, so that products may be printed at each of the geographically remote locations which have colors that are substantially indistinguishable by the naked human eye from one location to the other.

According to another aspect of the invention there is provided a method of insuring precise color consistency of substantially identical printed products printed at a plurality of different geographically remote locations, comprising: a) Specifying a plurality of precisely defined colors to be printed on the products. b) Determining a reproducible ink formulation for each of the plurality of precisely defined colors. c) Screen printing a plurality of substantially identical sample products using the ink formulations from b). And d) distributing the formulations from b) and a sample product from c) to each of the plurality of different geographically remote locations, so that products may be printed at each of the geographically remote locations corresponding to the sample products, and which have colors that are substantially indistinguishable by the naked human eye from one location to the other.

Also in the method according to this aspect of the invention, d) may be further practiced by supplying ink for use in formulating inks based on the formulations to each of the geographically remote locations. Also b) and d) may be further practiced by distributing the formulations in the form of cards, each card having the complete formulation for each precisely defined color, including the various inks and percentages of the various inks making up each color, imaged thereon; and b) and d) may be still further practiced by distributing cards having the ink formulations on one face thereof, and product-simulating indicia on another face thereof, which product-simulating indicia accurately simulates the sample product, including the precisely defined colors thereof. The method may still further comprise e) obtaining actual printed product samples from each of the geographically remote locations and approving the samples; and after f) running production runs of the printed products and distributing the printed products from the production runs. Also, d) may be further practiced by distributing each sample product and corresponding color formulation card together in a set, releasably held together.

The invention also relates to a plurality of substantially identical products (such as compact discs) screen printed at geographically remote locations by practicing any of the methods as set forth above.

According to yet another aspect of the present invention there is provided a plurality of sets of substantially identical product-printing facilitating kits, each set comprising: A sample product having a plurality of predetermined precisely defined colors printed thereon with precisely formulated colored inks. And a formulation card having indicia thereon defining the precise formulation for each of the precisely formulated colored inks.

The sample product may comprise a substantially flat product, such as a compact disc or signage. Each set may further comprise a carrier having at least first and second pockets dimensioned to fit the product (e.g. CD) and card, respectively, therein, the product disposed in the first pocket and the card in the second pocket. The card may have first and second faces, with the formulation indicia imaged on the first face, and product simulating indicia imaged on the second face, which product simulating indicia accurately simulates the sample product, including the precisely defined colors thereof.

It is the primary object of the present invention to insure printing of products at geographically remote locations that have colors that are so precisely matched that they are substantially indistinguishable from each other by the naked human eye. This and other objects of the invention will become clear from an inspection of the detailed description of the invention and from the appended claims.

DETAILED DESCRIPTION OF THE DRAWINGS

Figure 1:
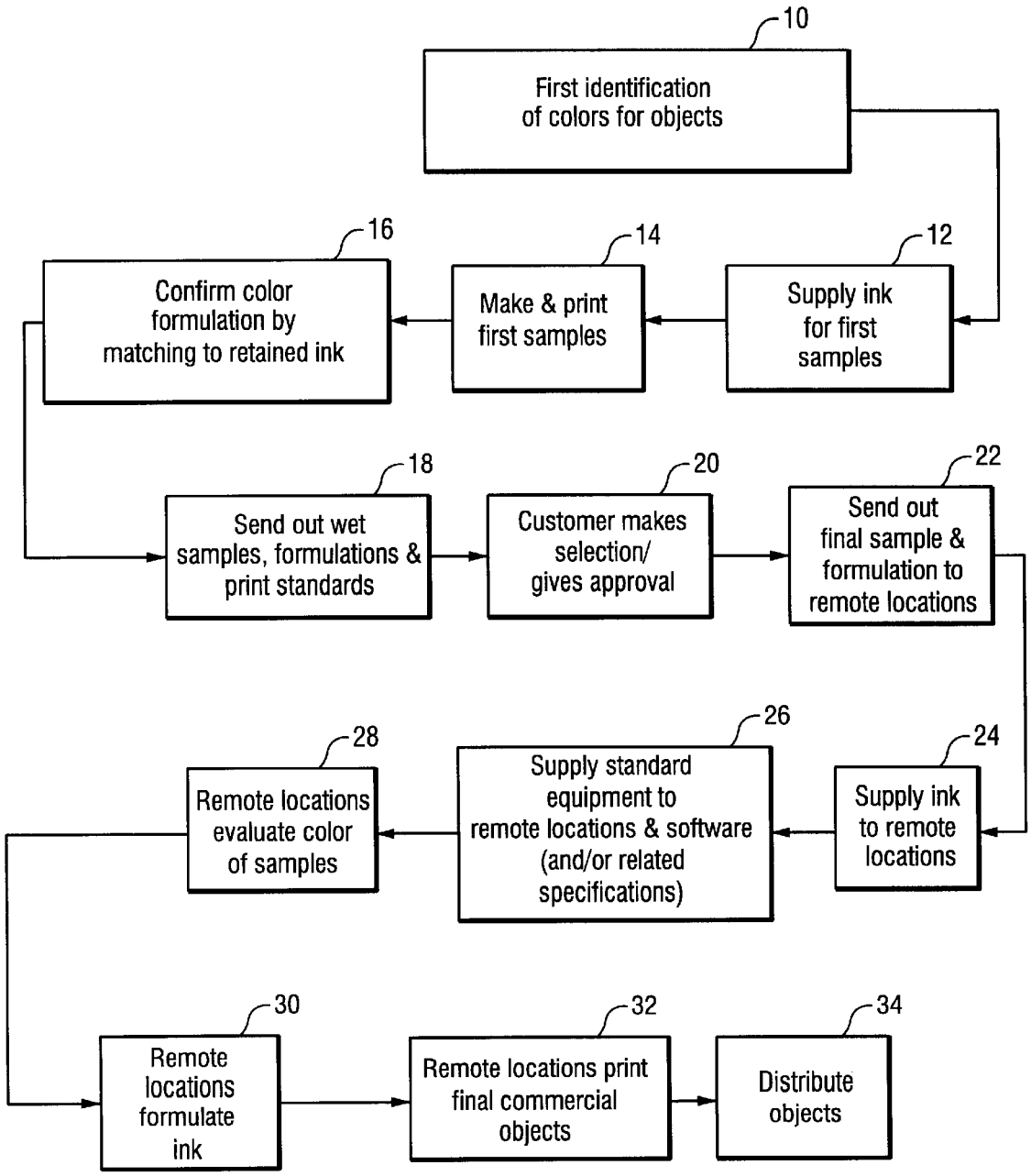
FIG. 1 is a box diagram showing one aspect of a method according to the present invention.

FIG. 1 schematically illustrates an exemplary method according to the present invention. The entire purpose of the method of FIG. 1 is to product a printed product a plurality of geographically remote locations, which typically have different environmental criteria, which have colors that when printed are substantially indistinguishable by the naked human eye, so that a product that is produced in one location cannot be distinguished by the average person from a product produced at another location. This allows an organization to have complete control over its image and/or brand, which enhances the reputation of the organization, while also making its products more difficult to counterfeit.

In the method schematically illustrated in FIG. 1, the first illustrated procedure is the identification of colors for the products that will be printed. For example, a product may be printed having red, blue, and yellow colors thereon. The identification of the colors may be using the Pantone system (which typically identifies colors by the letters PMS, a number, and then a color, such as "PMS 485 Red"), but the color identification can be done in another manner in addition to, or instead of, using the Pantone system. Once colors are identified, ink is supplied, as indicated at 12, for the first samples which are typically produced at one location, so as to establish the benchmark which all other products that are commercially produced must simulate. Then the first samples are made and printed, as illustrated at 14 in FIG. 1. For example, if the products are compact discs, the discs will be made and printed at a first location, to produce a plurality of first samples. Only one color and/or design combination may be printed as the first set of samples, or a plurality of different colors and/or design combinations may be made up and the organization that will be utilizing them can make a decision, using any criteria or techniques that it desires, to select which sample(s) is (are) appropriate.

After a particular first sample has been selected, preferably—as illustrated at 16 in FIG. 1—the color formulation thereof is confirmed by matching to retained ink, from the ink supplied in the first samples stage 12. Then it is desirable, as indicated at 18 in FIG. 1, to send out wet samples (that is actual inks) for evaluation of print standards. Ultimately, as indicated at 20 in FIG. 1, the customer (or the organization itself) makes a selection (gives approval) for a particular sample product (such as the product 52 illustrated in FIG. 3). That sample product has the precisely defined colors desired, and is the sample that all of the geographically remote printing facilities are to match.

As indicated at 22 in FIG. 1, once the final samples have been selected, preferably a sample, and a formulation of inks to make up the sample, are sent to various remote printing locations. For example, sample 52 and a card 54 in a carrier 70 (see FIGS. 3 through 6) is sent out to each of the geographically remote locations. The formulations on the cards 58 may vary from location to location depending upon environmental criteria existing at those locations, as will be hereinafter explained. In addition to sending out the sample and color formulations to the remote locations, also preferably the ink used in the formulations is supplied to the remote locations, as illustrated at 24, either from a central source, or from quality-controlled local sources close to each, or at least some of, the remote locations.

As illustrated at 26 in FIG. 1, it may also be optionally desirable to supply standard equipment and software (and/or related specifications) to as many of the remote locations as possible, preferably all. For example, for many screen printing facilities for printing objects such as compact discs, or promotional clothing or other items, it is highly desirable to use common equipment and software packages. For example, 26 in FIG. 1 may be implemented by supplying (either by actual shipping to, requiring the location to purchase, or other technique) a spectrophotometer to each of the remote locations (such as a Geretag Macbeth "Color-Eye®" 2180 UV spectrophotometer), and common software, such as Geretag Macbeth color quality software, Gretag Macbeth ink formulation software, and consistent computer programs that allow consistent reading and use of digital files, including for vector graphics, page makeup, photographic images, fonts, and the like.

Especially where each of the geographically remote locations has a standard spectrophotometer, as indicated at 28 in FIG. 1, each of the remote locations may evaluate the color of the samples 52 provided thereto, so that the color can be compared to first specimens printed at each of the remote locations to insure that the colors match up properly.

Ultimately at each of the remote locations, the differently colored inks will be formulated, as illustrated at 30 in FIG. 1, from the ink supplied at 24 and using the formulations from 58 that are specific to each of the remote locations. Then, either with or without customer organization approval of the first specimens printed at each of the remote locations, depending upon the desires of the customer or organization, production runs of the products are produced at each of the remote locations, as illustrated at 32. While depending upon the particular products involved the printing techniques may be different, for most products, such as CDs, plastic bottles, promotional clothing, and signage, printing will be screen printing. Ultimately then, the products are distributed, as illustrated at 34 in FIG. 1, either from each of the remote locations to ultimate customers general proximate those remote locations, or to geographically spaced or central distribution facilities. The ultimate products that are produced, regardless of the ultimate geographic location at which they are produced, have colors that are indistinguishable from each other by the naked human eye of the ultimate customers to whom the printed products are to be distributed.

Figure 2:
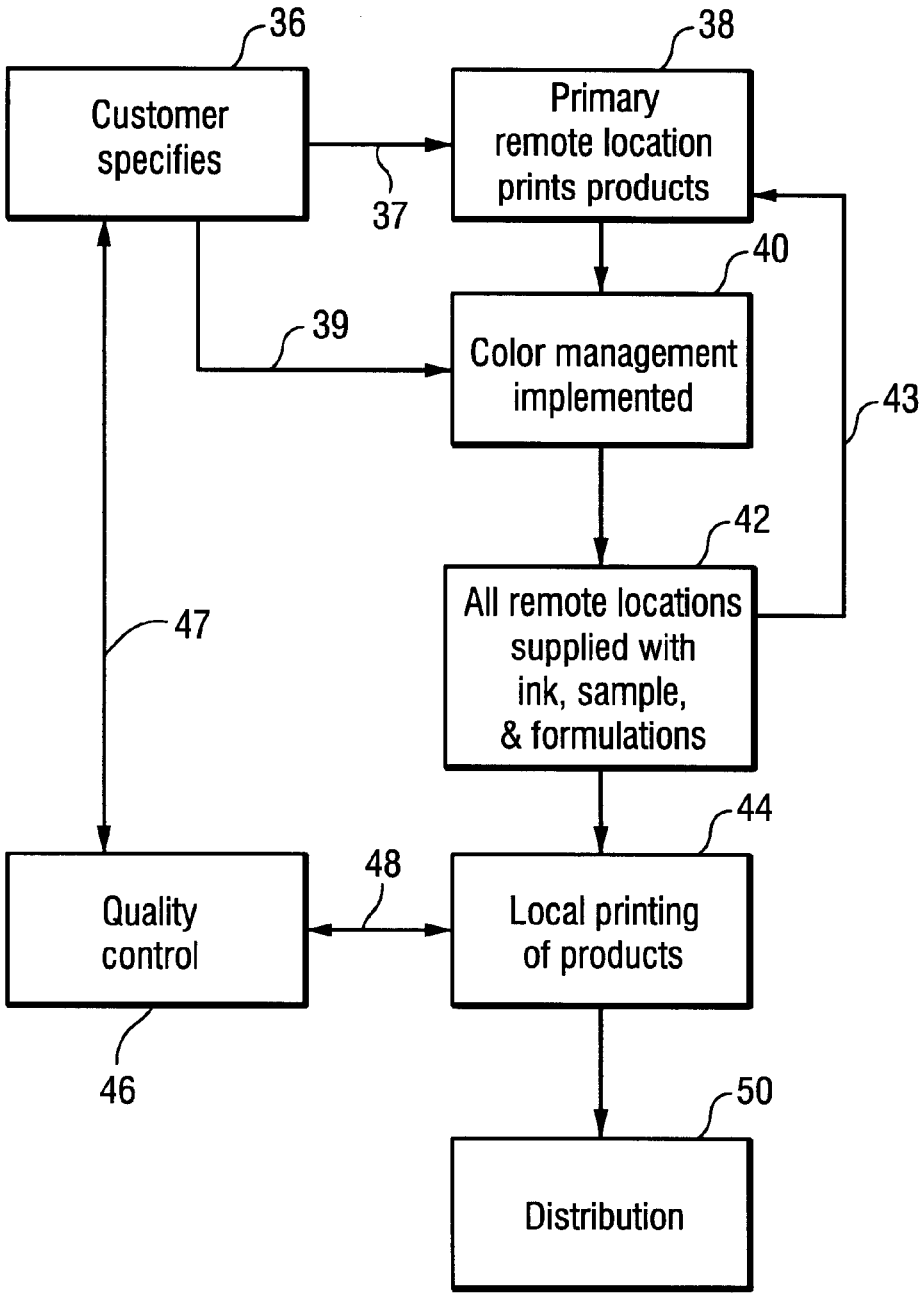
FIG. 2 is a modification of the method of FIG. 1, also illustrated in box diagram form.

FIG. 2 illustrates a minor variation, in simplified form, of the method of FIG. 2. As indicated at 36 in FIG. 2, a customer specifies the colors to be used in the products. This information is transmitted (see 37) to the primary location where sample products are printed (38 in FIG. 2), and (via 39) to a central color management implementation location 40. The appropriate inks are supplied to the location 38 for the printing of the sample products, and color management at 40 is implemented to insure the precise formulation of the inks depending upon what the environmental criteria are at various geographically remote locations. For example, different geographically remote locations may use different types of screen printing equipment, have different temperature and/or humidity conditions, may typically use different additives, or may otherwise have other criteria that differ from place to place which have a significant effect on the colors that are printed.

Ultimately, the color management implementation 40 supplies to all the geographic locations ink, sample products 52, and formulations (see 58 in FIG. 4), and local printing of the products at each of the geographically remote locations (44) takes place. Initially preferably only specimens are printed at the geographically remote locations, and the quality control—illustrated at 46 in FIG. 2—is implemented. Customer review of the specimens printed at the various geographic locations takes place (see 47 in FIG. 2), and feedback is given to each of the geographic locations depending upon the product supplied thereby to the quality control 46 (see 48 in FIG. 2). Ultimately after appropriate quality control procedures have been satisfied, final screen print production runs are run at the various locations (44), and the printed commercial products are distributed as indicated at 50 in FIG. 2, either from each of the printing locations, from locations proximate the printing locations, or from central distribution facilities.

Figure 3:
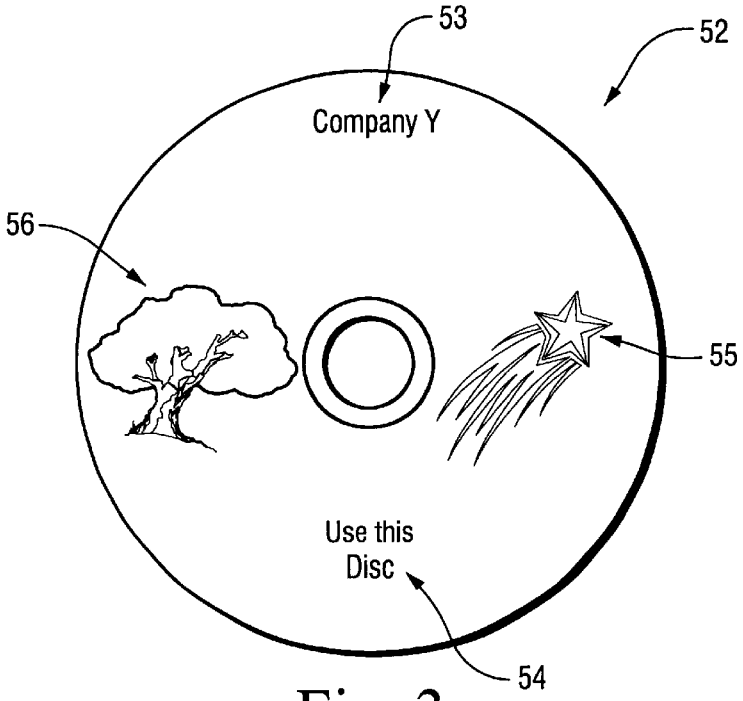
FIG. 3 is a representation of a sample product produced according to the present invention.

While the methods as described above can be used for the printing of a wide variety of products, one product that is particularly suitable is a compact disc. FIG. 3 illustrates an exemplary compact disc 52 that is produced according to the present invention, not only as a sample that is supplied to each of the remote locations, but as a final product that will ultimately be produced in each location. The sample/final compact disc 52 may have any suitable indicia printed thereon (typically by screen printing), such as the name of the company or organization providing the disc 52 (see 53 in FIG. 3), human readable instructions 54, and various graphic or design elements 55, 56. The indicia 53, 54, and/or design elements 55, 56, as well as the entire background of the CD 52 will have a plurality of colors (not counting black), typically three or even four colors, which will of course vary depending upon the organization's desires. For the disc 52 of FIG. 3, it will be assumed that three colors are provided, a particular one of each of red, blue, and yellow.

Figure 4:
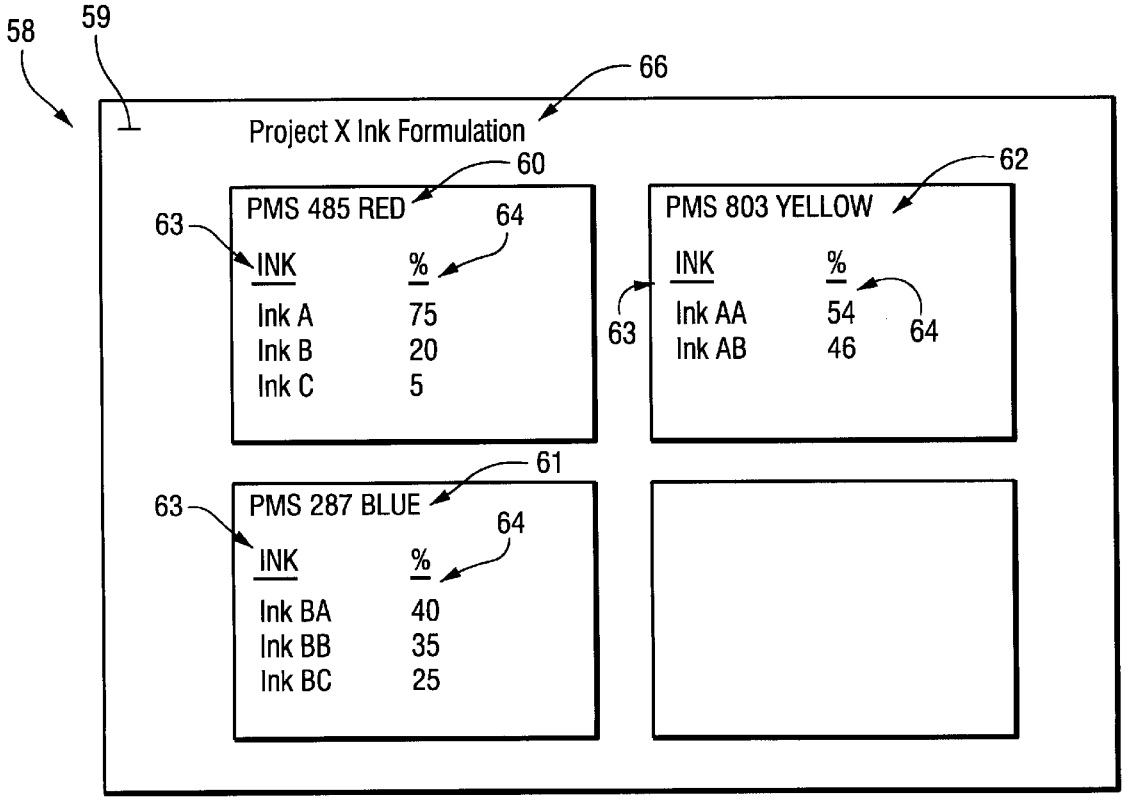
FIGS. 4 and 5 are top and bottom views of an exemplary formulation card according to the present invention.
Figure 5:
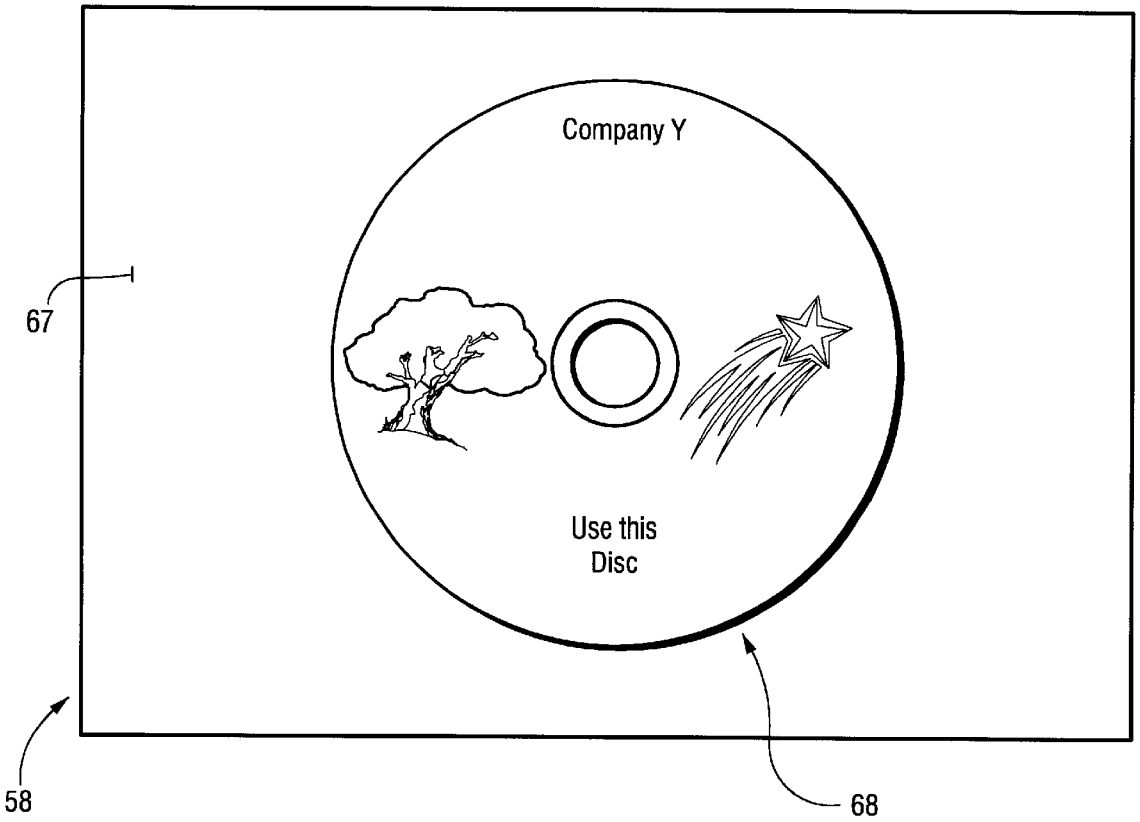

At some point during the methods of FIGS. 1 and 2 (e.g. in 16 and 22 of FIG. 1, or in 40 of FIG. 2), it is likely necessary to provide specific detailed formulations for each of the red, blue, and yellow colors being produced, which formulations vary depending upon the environmental criteria at various geographically remote locations. This information can be transmitted to the geographically remote locations electronically, but it is highly desirable to exclusively, or in addition, transmit the information physically along with the sample 52 so that the possibility of errors or waste is minimized. This is typically done using one or more cards 58 as illustrated in FIGS. 4 and 5. The cards 58 may have any suitable construction, such as conventional card stock printed or otherwise imaged with the desired information, and then laminated with clear plastic to protect the information thereon.

For the exemplary card 58 of FIGS. 4 and 5, the first face 59 (FIG. 4) may have indicia thereon such as the indicia 60 through 64, and 66, illustrated in FIG. 4. The indicia 60, 61, and 62 are the particular colors for each of the three final inks that are to be formulated and applied to produce a disc 52. The indicia 60, 61, and 62, for clarity of illustration, are specified pursuant to the Pantone system, but other specifications may be provided. For each of the colors 60–62, a plurality of particular inks, listed in column 63, are specified, as well as the percentages for each of those inks, as illustrated at 64. Depending upon the environmental criteria existing at various geographically remote locations, the particular inks and/or the particular percentages to get the color 60, for example, may differ so that a plurality of cards 58 are produced with different indicia 63, 64, but all designed to produce a completely uniform color product 52. For example three of the geographic locations may have the particular inks and percentages specified at 63 and 64 for the red color 60 in FIG. 4, while another group of locations which use different screen printing equipment, have different inks 63 and/or percentages 64, while still another group of locations that have other different environmental criteria have still other inks 63 and/or percentages 64. Typically some common indicia, such as illustrated schematically at 66 in FIG. 4 is provided to indicate what particular project/product the card 58 formulations relate to.

Although not necessary, it is also desirable to provide on the second face 67 (see FIG. 5) of the card 58 other indicia. The highly desired other indicia comprises product simulating indicia 68 (see FIG. 5) which accurately simulate the sample product 52, including the precisely defined colors thereof. By using the simulating indicia 68 it can be insured that there is no doubt about what product the formulation 58 relates to, and under some circumstances the colors on the simulation 68 may be evaluated (e.g. by a spectrophotometer) instead of the colors on the sample product 52, to insure that specimen products produced at a particular geographic location meet the desired standards.

Figure 6:
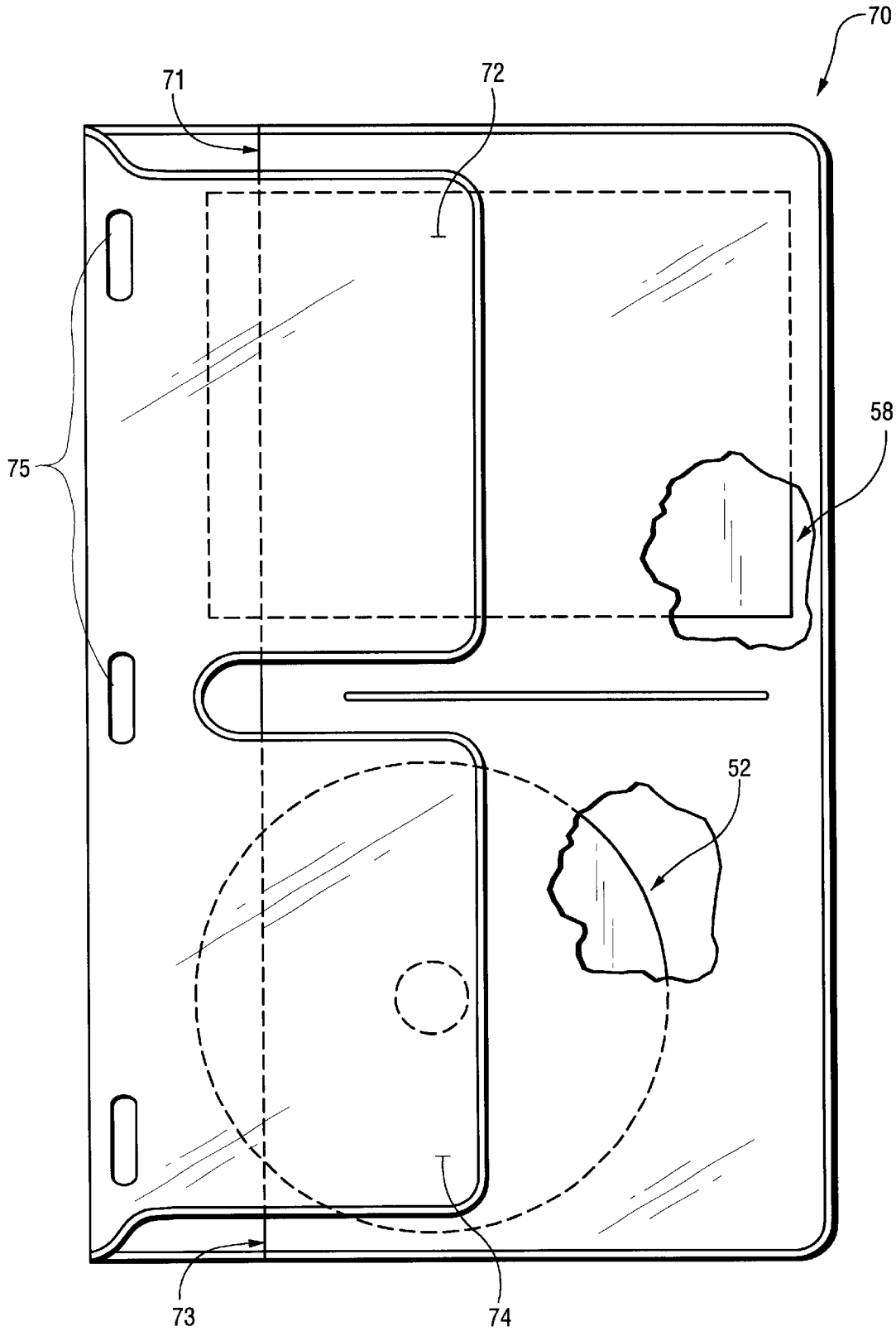
FIG. 6 is a top plan view of an exemplary carrier according to the present invention, with the sample product of FIG. 3 and the card of FIGS. 4 and 5 received therein.

One particularly effective way that the sample product 52 and formulation card 58 may be transmitted to each of the geographic remote locations is by using the commercially available, per se, carrier 70 of FIG. 6. The carrier 70 preferably is transparent or translucent, although under some circumstances it can be opaque, and if it is transparent or translucent typically need not be imaged with indicia indicating its contents. Carrier 70 includes a first pocket 51 covered by a flap 72 and a second pocket 73 covered by a flap 74. One pocket can contain the card 58 (e.g. the pocket 71 in FIG. 6) while the other pocket (73 in FIG. 6) contains the sample 52. To access the sample 52 and/or card 58 the flaps 74, 72 are merely pivoted out of the way, one's hand is inserted into the pocket 73, 71, and the product 52 or card 58 are removed. The carrier 70 may have holes 75 punched along the margin thereof, e.g. adjacent the flap 72, 74 to allow the carrier 70 to be kept in a notebook, or otherwise retained in a readily recoverable manner.

It will thus be seen that by practicing the methods according to the invention, and/or utilizing the sets of substantially identical product-printing facilitating kits (as indicated at 70 in FIG. 6) according to the invention, it is possible to produce products (such as the CD 52) at a number of geographically remote locations, having different environmental criteria, that have colors that are substantially indistinguishable by an average person, so that regardless of the location at which the product 52 is produced it looks the same to the ultimate consumers of the products. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of insuring precise color consistency of substantially identical printed products printed at a plurality of different geographically remote locations having different environmental criteria, comprising:

a) specifying a plurality of precisely defined colors to be printed on the products;

b) determining a plurality of different reproducible ink formulation for each of said plurality of precisely defined colors, said plurality of formulations differing depending upon said different environmental criteria so that regardless of the environmental criteria the colors when printed will be substantially indistinguishable by the naked human eye; and c) distributing the formulations from b), and supplying ink for use in formulating inks based on the formulations, to the plurality of different geographically remote locations, so that products may be printed at each of said geographically remote locations which have colors that are substantially indistinguishable by the naked human eye from one location to the other.

2. A method as recited in claim 1 further comprising d) screen printing the products at the geographically remote locations with the precisely defined colors.

3. A plurality of substantially identical compact discs screen printed at geographically remote locations by practicing the method of claim 2.

4. A method as recited in claim 1 wherein c) is further practiced to distribute with each formulation a sample product having said precisely defined colors printed thereon.

5. A method as recited in claim 4 further comprising d) distributing to each of the geographically remote locations common equipment for use in at least one of verifying, formulating ink, and printing of said precisely defined colors.

6. A method as recited in claim 5 wherein d) is further practiced by distributing a common spectrophotometer; and further comprising e) verifying the colors to be printed by comparing the colors on the sample to specimen colors printed at one of said geographically remote locations.

7. A method as recited in claim 4 wherein c) is practiced by distributing sample compact discs which are the products to be printed.

8. A method as recited in claim 4 wherein c) is further practiced by distributing the formulations in the form of cards, each card having the complete formulation for each precisely defined color, including the various inks and percentages of the various inks making up each color, imaged thereon.

9. A method as recited in claim 8 wherein c) is further practiced by distributing cards having said ink formulations on one face thereof, and product-simulating indicia on another face thereof, which product-simulating indicia accurately simulates said sample product, including said precisely defined colors thereof.

10. A method as recited in claim 8 wherein c) is further practiced by distributing each sample product and corresponding color formulation card together in a set, releasably held together.

11. A method as recited in claim 1 further comprising d) obtaining actual printed product samples from each of said geographically remote locations and approving the samples; and after d), e) running screen printing production runs of the printed products and distributing the printed products from the production runs.

12. A method of insuring precise color consistency of substantially identical printed products printed at a plurality of different geographically remote locations having different environmental criteria, comprising:

a) specifying a plurality of precisely defined colors to be printed on the products;

b) determining a plurality of different reproducible ink formulation for each of said plurality of precisely defined colors, said plurality of formulations differing depending upon said different environmental criteria so that regardless of the environmental criteria the colors when printed will be substantially indistinguishable by the naked human eye; and c) distributing the formulations from b) to the plurality of different geographically remote locations, so that products may be printed at each of said geographically remote locations which have colors that are substantially indistinguishable by the naked human eye from one location to the other.

13. A method of insuring precise color consistency of substantially identical printed products printed at a plurality of different geographically remote locations, comprising:

a) specifying a plurality of precisely defined colors to be printed on the products;

b) determining a reproducible ink formulation for each of said plurality of precisely defined colors;

c) screen printing a plurality of substantially identical sample products using the ink formulations from b); and d) distributing the formulations from b) and a sample product from c) to each of the plurality of different geographically remote locations, so that products may be printed at each of said geographically remote locations corresponding to said sample products, and which have colors that are substantially indistinguishable by the naked human eye from one location to the other.

14. A method a recited n claim 13 wherein d) is further practiced by supplying ink for use in formulating inks based on the formulations to each of the geographically remote locations.

15. A method as recited in claim 13 wherein b) and d) are further practiced by distributing the formulations in the form of cards, each card having the complete formulation for each precisely defined color, including the various inks and percentages of the various inks making up each color, imaged thereon.

16. A method as recited in claim 15 wherein b) and d) are further practiced by distributing cards having said ink formulations on one face thereof, and product-simulating indicia on another face thereof, which product-simulating indicia accurately simulates said sample product, including said precisely defined colors thereof.

17. A method as recited in claim 15 wherein d) is further practiced by distributing each sample product and corresponding color formulation card together in a set, releasably held together.

18. A method as recited in claim 13 further comprising e) obtaining actual printed product samples from each of said geographically remote locations and approving the samples; and after f) running production runs of the printed products and distributing the printed products from the production runs.

19. A plurality of substantially identical compact discs screen printed at geographically remote locations by practicing the method of claim 18.

* * * * *